United States Patent [19]

Smith

[11] 4,163,349

[45] Aug. 7, 1979

[54] INSULATED BUILDING PANELS

[76] Inventor: Glenn W. Smith, P.O. Box 36, Russells Point, Ohio 43348

[21] Appl. No.: 800,697

[22] Filed: May 26, 1977

[51] Int. Cl.[2] ..... E04H 1/00; E04C 1/00

[52] U.S. Cl. ..... 52/241; 52/243; 52/281; 52/284; 52/309.2; 52/309.7; 52/309.16; 52/586

[58] Field of Search ..... 52/745, 272, 241, 281, 52/242, 284, 243, 285, 586, 286, 264, 496, 265, 267, 268, 269, 270, 309.7, 309.2, 309.16

[56] References Cited

U.S. PATENT DOCUMENTS

| | | | |
|---|---|---|---|
| 2,065,433 | 12/1936 | Dercum et al. | 52/281 X |
| 2,129,441 | 9/1938 | Otto | 52/271 X |
| 2,332,732 | 10/1943 | Laucks | 52/243 X |
| 2,521,381 | 9/1950 | Linck | 52/281 X |
| 3,386,216 | 6/1968 | Zwickert | 52/242 X |
| 3,415,026 | 12/1968 | Tillisch et al. | 52/241 X |
| 3,462,897 | 8/1969 | Wernrott | 52/285 X |
| 3,466,821 | 9/1969 | O'Shaughnessy et al. | 52/241 X |
| 3,471,984 | 10/1969 | Hayes | 52/586 X |
| 3,866,371 | 2/1975 | Falconer | 52/281 |
| 3,992,829 | 11/1976 | Schellberg | 52/284 X |
| 4,014,143 | 3/1977 | Purcell | 52/265 X |

FOREIGN PATENT DOCUMENTS

| | | | |
|---|---|---|---|
| 293902 | 3/1968 | Australia | 52/241 |
| 2010667 | 9/1971 | Fed. Rep. of Germany | 52/285 |
| 2318624 | 10/1974 | Fed. Rep. of Germany | 52/284 |
| 2321973 | 11/1974 | Fed. Rep. of Germany | 52/241 |
| 1290982 | 3/1962 | France | 52/272 |
| 1362659 | 4/1964 | France | 52/272 |
| 1523484 | 3/1968 | France | 52/241 |
| 2230823 | 12/1974 | France | 52/265 |
| 2287559 | 6/1976 | France | 52/265 |
| 68826 | 5/1947 | Norway | 52/284 |
| 372149 | 11/1963 | Switzerland | 52/270 |
| 770342 | 3/1957 | United Kingdom | 52/241 |

*Primary Examiner*—Leslie Braun

*Attorney, Agent, or Firm*—Wood, Herron & Evans

[57] ABSTRACT

An insulated building panel includes a core and overlapping skins, the interior skin at the panel's bottom covering a panel foot plate and the exterior skin at the panel's bottom covering the foot plate and extending beyond to form an erection stop. End panels have relieved core areas for receiving bearing members associated with a wall splice bearing post, and double parallel spaced header beams have offset splice areas within a several panel wall section. Two end panels include improved end structure for forming an improved corner at the panel's intersection. Methods are provided for making and erecting a multiple panel wall section.

8 Claims, 7 Drawing Figures

INSULATED BUILDING PANELS

This invention relates to building and building structures and more particularly to insulated building panels and wall sections and to methods adapted to form an insulated building wall.

Insulated building panels used in wall construction are old and well known in the art. Many such panels comprise an insulating core material covered on each side by an appropriate sheet material. While such known panels have been used in the building industry for some time, many of them are awkward and difficult to handle, both in their own construction and in utilizing or erecting them to form the walls of a building.

It has thus been one objective of this invention to provide a new and improved insulated building panels and wall section.

A particular objective of this invention has been to provide an improved insulated building panel including structure permitting its rapid efficient connection to other panels and including structure permitting its efficient field erection as part of a wall in a building.

A further objective of this invention has been to provide improved insulated building wall sections and improved structures therein for connection to other sections to form straight walls or corners, and for efficiently erecting the wall sections.

A further objective of the invention has been to provide new and improved methods for making insulated wall sections and for erecting same to form a wall.

In a preferred embodiment of this invention, an insulated wall section, adapted for erection on a deck having a mounting plate thereon, includes one or more insulated panels, each comprising an insulating core and having an exterior skin on one side and an interior skin on another side. The skins overlap the core about its periphery and at the sides of the panel extend from the core a distance to receive a portion of a bearing post to which adjacent panels are connected. At the bottom of each panel, the interior skin overlaps the core only a distance equal to the thickness of a foot plate in the panel. The exterior skin, however, overlaps both core and footplate to provide a locating stop for use in erecting the panel and wall section.

In a preferred several-panel wall section according to the invention, header beams run between the overlapping exterior and interior skins at the upper end of each panel and terminate coextensive with the skins of end panels on the respective ends of the wall section. In this manner, the header beams of a wall section terminate over the compression point of a bearing post joining two wall sections.

The end panels in each wall section have a relieved upper core area for receiving bearing members associated with a wall section splice bearing post intermediate two wall sections. These bearing members increase the header bearing area on the splice bearing post for supporting the terminating header beams of respective adjoining wall sections.

Within each wall section, double header beams, resting on their edges, are disposed in parallel between the exterior and interior panel skins. The relationship between the thickness of the insulating core and the thickness of the header beams is such that a space is maintained between the two header beams. When two single header beams, as long as a wall section are impractical, shorter beams are used in abutting relationship. The shorter beams are joined at header splice areas intermediate the edges of a panel, and the bearing posts between panels, such that the ends of the shorter header beams are cantilevered over respective bearing posts. At the splice area, a splice plate is inserted to span the abutting beams. The beams are nailed and glued to this place to form a header splice. The nails may be of sufficient length to extend through the splice plate into the parallel header beam. Preferably, the parallel header beams are not spliced between the same bearing posts within a wall section. Thus within a wall section, the splice area in one header beam is offset from the splice area in the other spaced parallel header beam. The only position in which parallel header beams terminate in the same area is over the wall section splice bearing post.

In use, a several-panel wall section or a panel is constructed at one site and then is transported to a building site for erection on a deck, foundation, or other structure. Preferably, a deck is provided with a permanently secured mounting plate which shall serve as a positioning member for the wall section. The wall section is craned or lifted into position and is laterally moved into final position where the exterior skins abuts the mounting plate, since it extends further than the interior skin. The interior skin clears the mounting plate permitting viewing of the wall section's position before final erection of the section with the panel foot plate resting directly on the mounting plates. The ability to laterally or transversely move the wall section into final position eliminates the need to drop it vertically and precisely onto the mounting structure, thus increasing erection speed and efficiency; and the ability to see its final position from the interior skin side assures accuracy of disposition.

When it is necessary to form a corner, the skins of one end panel are coterminus, overlapping the core and covering a corner bearing post. A corner nailer post is secured through the interior skin to the corner bearing post. A second end panel has an exterior skin of sufficient overlap to cover its core, the corner nailer post, the interior skin thickness, the corner bearing post, and the exterior skin thickness of the other panel. The interior skin of the second end panel has sufficient core overlap to cover only the corner nailer post. Thus, the second panel is moved normal to the end of the first and is connected thereto, the exterior skin of the second panel being nailed to the corner nailer post and to the corner bearing post while the interior skin of the second panel is nailed to the corner nailer post.

Accordingly, the invention provides highly improved insulated panels and wall sections made therefrom and which significantly increase speed and efficiency in wall section construction and erection.

These and other advantages will become readily apparent from the following detailed description of a preferred embodiment of the invention and from the drawings in which.

Figure 1:
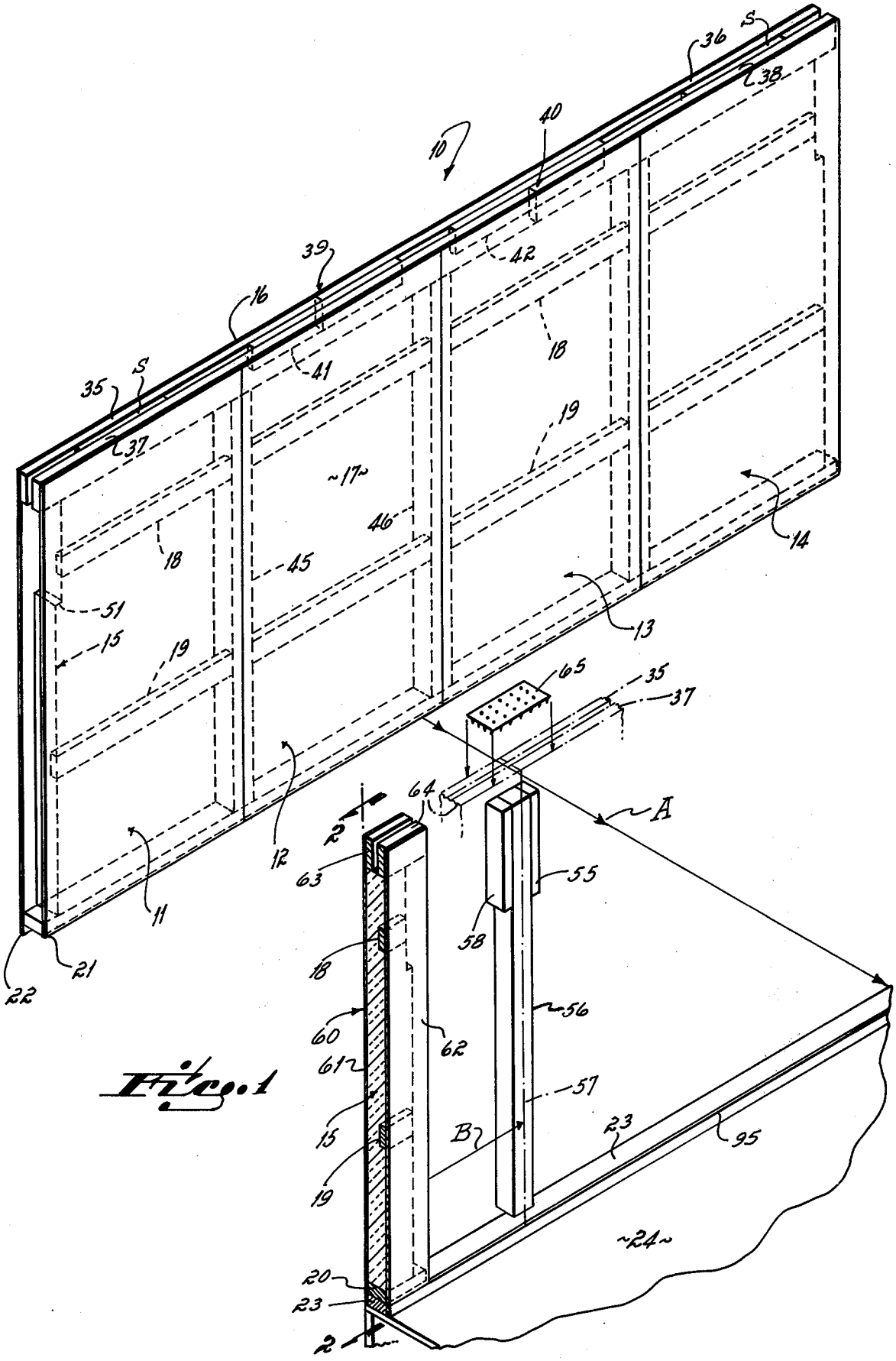
FIG. 1 is a perspective view showing multiple panel wall sections and deck, according to the invention, prior to final assembly of the sections to the deck.

Turning now to the drawings, there is shown in FIG. 1 thereof a wall section 10 including a plurality of insulated building panels 11, 12, 13 and 14. The details of each individual panel are perhaps best seen in FIG. 4. Each panel includes an insulating core member 15, which is preferably formed from a polymeric foam insulating material. Of course, the panel may be formed of any suitable insulating material as will be appreciated.

The panel further includes an exterior skin 16 and an interior skin 17. Exterior skin 16 is preferably formed from exterior grade plywood, for example, and is laminated to the core 15 by the expedient of an appropriate adhesive. Interior skin 17 is preferably formed from drywall sheet material and is also laminated via an appropriate adhesive to the core 15.

Figure 4:
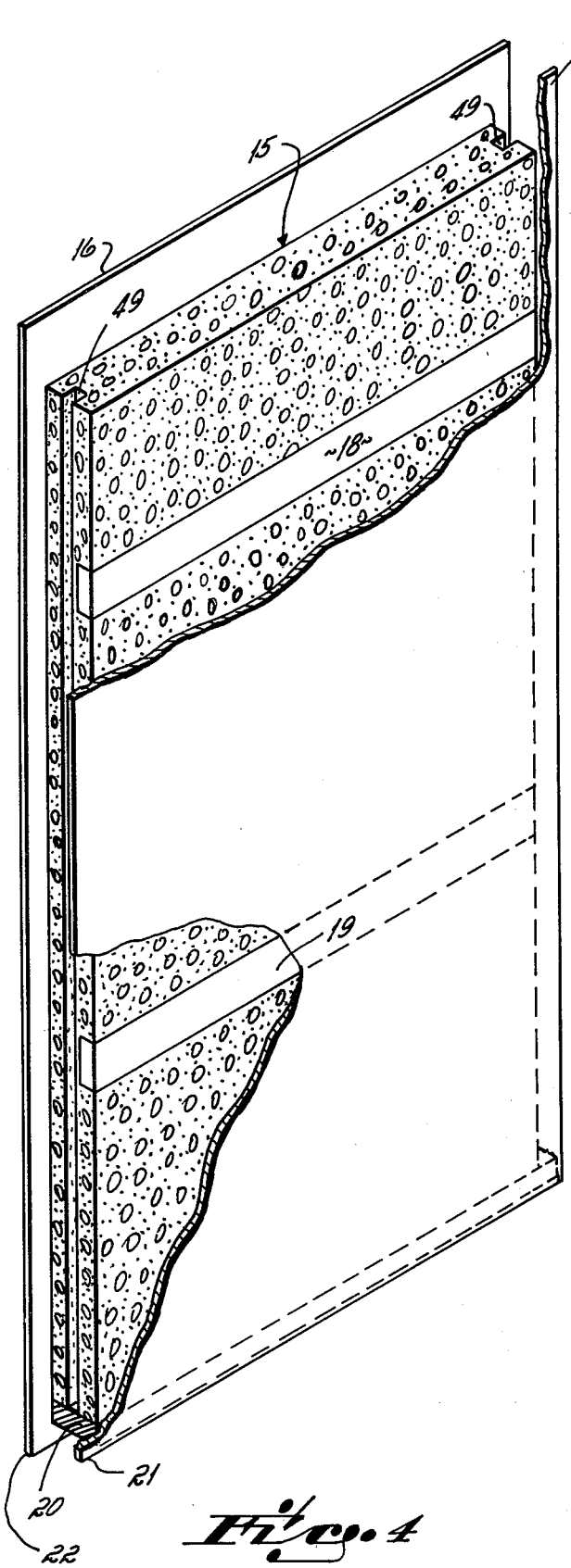
FIG. 4 is a perspective view of a single panel according to the invention.

As shown in the representative panel of FIG. 4, each panel may be provided with nailing strips 18 and 19. Such strips will not be necessary in all panels; however, in panels for utilization in kitchens, for example, where it is necessary to mount the cabinets and other heavy items on the walls, the nailing strips 18 and 19 are embedded in appropriate cutouts of the core 15 before the interior skin 17 is applied thereto. The nailer strips 18 and 19 thus form a sound base for receiving nails, screws or other fasteners for the purpose of mounting cabinets and the like to the panels.

As shown in FIG. 4, each of the exterior and interior skins 16 and 17 respectively, overlap the core 15 on all sides thereof. The skins 16 and 17 are essentially coterminous at the upper end of the panel of FIG. 4 and overlap the core a sufficient distance so that the skins may accommodate header beams as will be described. At both edges of the panel, the exterior and interior skins are also coterminous, but overlap the core 15 a distance equal to approximately one-half the width of a wall bearing post, also as will be described.

Figures 2, 3:
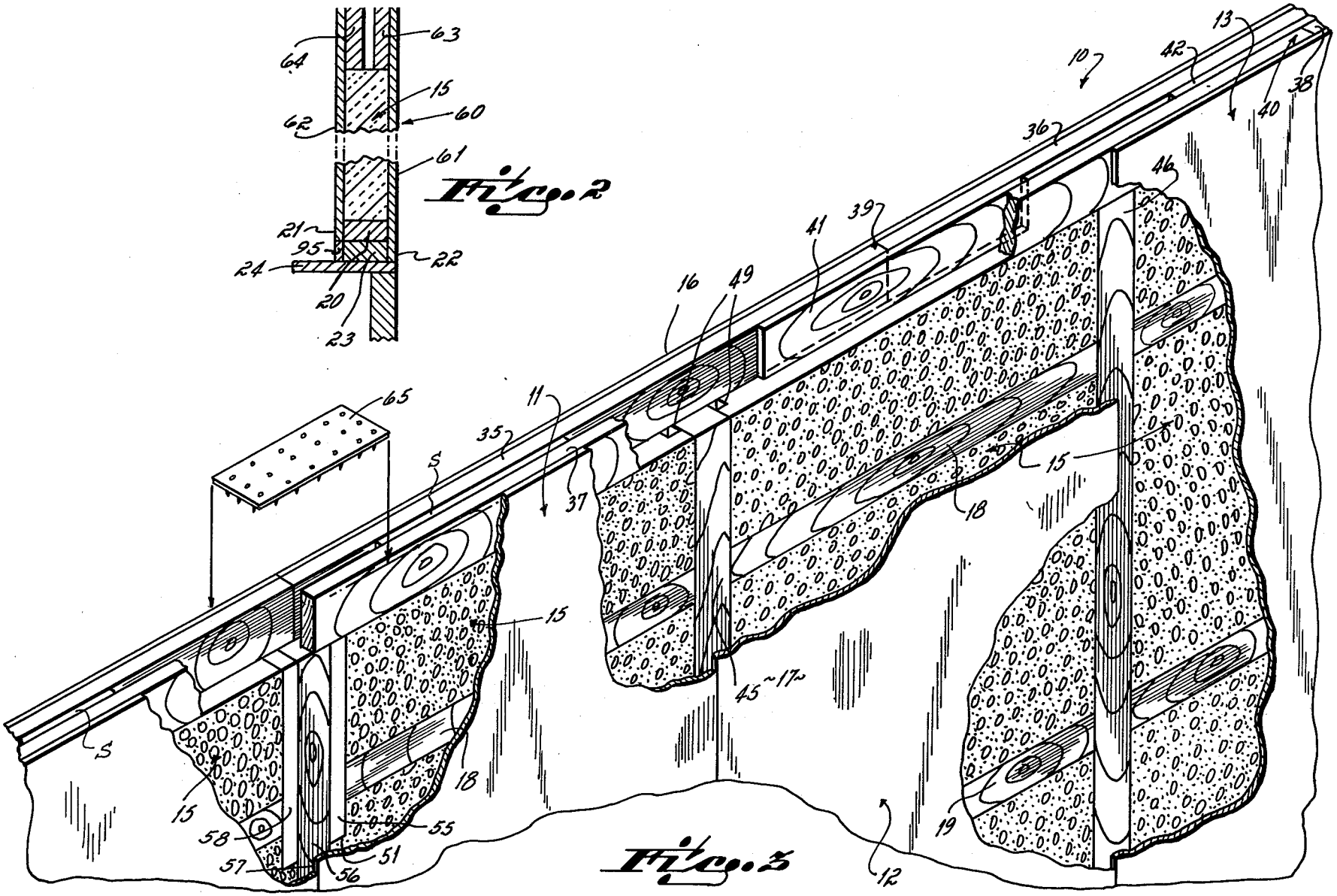
FIG. 2 is a cross-sectional view taken along lines 2—2 of FIG. 1.
FIG. 3 is a perspective view showing details of a wall section and panels according to the invention.

For clarity, the representative panel in FIG. 4 does not completely show the panel bottom structure. The bottom structure of the panel is best seen in FIG. 1 and more particularly in FIG. 2. Turning to FIG. 2, it will be appreciated that the bottom of each panel is provided with a continuous foot plate 20 which abuts the bottom of core 15 so that a single foot plate 20 may reside beneath the lower ends of bearing posts in a wall section as will be described. Interior skin 17 has a lower edge 21 which overlaps the core 15 a distance approximately equal to the thickness of the foot plate 20, thus the skin 17 is coterminous with the foot plate 20. On the other hand, exterior skin 16 has a lower edge portion 22 which overlaps the core 15 and the foot plate 20, and extends beyond the foot plate 20, in a preferred embodiment, a distance approximately equal to the thickness of a mounting plate 23 which is mounted on an appropriate floor or deck member 24. Thus, it will be appreciated that when the lower end of the panel or the wall section 10 is to be erected on the mounting plate 23, it is not necessary to lower the panel vertically over the mounting plate 23. The wall section 10 (and the panel) need only be moved transversely against the mounting plate 23, with the lower end 22 of the exterior skin 16 forming a stop or locating member for engagement with the mounting plate 23, all in order to accurately position the wall section 10 on the deck 24.

Continuing with the description of the invention, a preferable wall section as shown in FIG. 1 comprises four panels 11–14 which are preferably manufactured and joined together to form a wall section 10 at a manufacturing or factory site. The integral wall section is then shipped to a construction site where the wall section is assembled to an appropriate deck or foundation to form the wall of a building.

The wall section 10 includes a double header beam as shown in FIG. 1. For purposes of description, the double header beam comprises an exterior header beam and an interior header beam, the exterior header lying against the exterior skin 16 of the panel and the interior header beam lying against the interior skin of the panels. As shown in FIG. 1, and in FIG. 2, the exterior and interior header beams are in parallel relationship, the header beams each being of such a thickness, as compared to the thickness of the panel core 15, that when the header beams are in place against their respective panel skins, they are spaced apart by a one-half inch plywood spacer S which may double as a splice plate as will be described.

In a wall section 10 such as that shown in FIG. 1, the wall section may be of such a length that single exterior and interior header beams are impractical, and it becomes necessary to utilize more than one member to form each of the exterior and interior beams. Accordingly, wall section 10 in FIG. 1 includes exterior header beams 35 and 36, and interior header beams 37 and 38. Header beams 35 and 36 are spliced together at a header splice area 39, while the interior header beams 37 and 38 are spliced together at a header beam splice area 40. From this description it will be appreciated that the splice areas 39 and 40 are staggered, that is, the splice areas of the interior and exterior header beams do not fall within the dimensions of a single panel within the wall section 10, but rather splice area 39 is located within the confines of the panel 12 while splice area 40 is located within the confines of panel 13. The splice areas are thus offset from each other.

The splices between the respective header beams are formed through the utilization of splice plates 41 and 42. In the construction of the wall section 10, the beams 35 and 36 are inserted across the tops of the panel cores 15 and are abutted at the splice area 39. Thereafter, splice plate 41 is inserted between the interior and exterior header beams at the splice area 39.

The beams 35 and 36 are then nailed and/or glued to the splice plate 41. Also, splice plate 41 is nailed and/or glued to the interior header beam 37. In like manner, the splice between header beams 37 and 38 is accomplished at splice area 40 through the utilization of splice plate 42 which is also nailed and/or glued to both of the beams 37 and 38 and to the exterior header beams 36 thereby forming a header beam splice. Preferably, the header beam members are constructed after the panels 11, 12, 13 and 14 have been connected together via intermediate wall section or header bearing posts 45 and 46 as shown in FIG. 3.

To support and space the header beams, the spacers S are used within each panel where there is no header splice. Thus, in other words, each panel includes a spacer between the headers, some of which are used as splice plates such as 41 and 42.

As has previously been stated, the edge construction of each panel is such that the exterior and interior skin 16 and 17 overlap the core 15. Each overlap is equal approximately to the distance of one-half the width of a bearing post, such as at 45 and 46, and adjacent panels are joined together by nailing both the interior and exterior skins to the respective portion of the bearing post which they overlap. Thus, the bearing post functions as both a bearing post and in addition as a connecting member for connecting adjacent panels. In addition, it should be noted that as shown in both FIGS. 3 and 4, the core 15 of each panel is slotted at 49 in order to provide a wiring channel so that any appropriate electrical wiring can be easily handled through the wall section by passing through the grooves and between the headers at a position where no plywood spacers are located.

In addition to these features, each wall section has two respective end panels, such as panels 11 and 14 as shown in FIG. 1. Panel 11 is provided at its upper end with a relieved portion 51 in the core area. The relieved portion is of sufficient depth to receive a bearing member 55 associated with a wall section splice bearing post 56 which is formed as part of wall section 10 although shown spaced therefrom in FIG. 1. Thus, the exterior and interior skins 16 and 17 overlap the splice bearing post and so that the bearing member 55 fits within the relieved core area 51. Panel 14 is provided with a similarly relieved core area for receiving the splice bearing post and associated bearing member associated with a wall section to which panel 14 is to be joined.

The wall section splice bearing post 56 is provided for the purpose of providing a splice between two wall sections. Since it is preferred that the wall sections be manufactured at one site, and then transported to a construction site, a single final wall may be of such a length which precludes the separate manufacture and transportation of a single wall section to the construction site. Accordingly, a single wall may be made from a plurality of wall sections. These wall sections are conveniently and expediently joined by the utilization of the wall section splice bearing posts 56 (one for each wall section) as has been described.

By way of further example, however, the end portion of a similar wall section 60 is moved in the direction of arrow B (FIG. 1) for connection to the wall section splice bearing post 56, associated with wall section 10. The end portion of the wall section 60 is of a similar construction to that of panel 14 of the wall section 10, for example, the wall section 60 including exterior skin 61 and interior skin 62, exterior header beam 63 and interior header beam 64. Parts of wall section 60 which are similar to like parts of wall section 10 or the panel of FIG. 4 are designated with identical identifying numerals. As will be appreciated in FIGS. 1 and 3, the header beams 35, 37 of wall section 10 and the header beams 63 and 64 of wall section 60 are approximately coterminous with the respective interior and exterior skins of the wall sections. Thus, when the two wall sections 10 and 60 are joined together, as shown in FIG. 3, the ends of the header beam terminate approximately on the center line 57 of the wall section splice bearing post 56. Thus, when the two wall sections are spliced together, the header beams rest on the bearing post and are directly coupled together by a truss plate 65. In order to provide additional header bearing area and support for the respective header beams, the bearing member 55 and the bearing member 58 are connected to the upper end of the bearing post 56 and provide upper surfaces for supporting the respective header beams.

Figure 5:
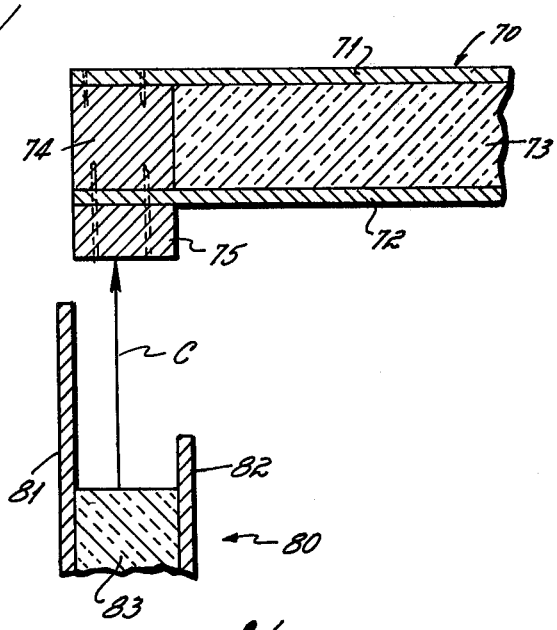
FIG. 5 is a top view of two corner panels, according to the invention, prior to connection.
Figure 6:
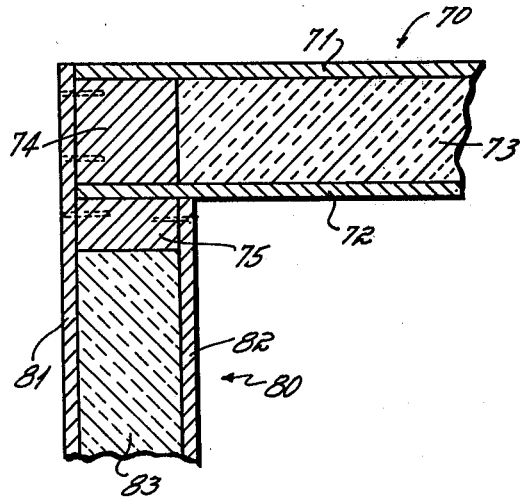
FIG. 6 is a top view of a corner assembly of two corner panels.

When it is desired to join two panels or wall sections together in order to form a 90° corner, each wall section or panel has modified edge structure. The corner construction is best seen in FIGS. 5 and 6. In FIG. 5, a first panel 70 includes an exterior skin 71, an interior skin 72 and a core 73. Each of the skins 71, 72 overlaps a corner bearing post 74 and is coterminous therewith. A corner nailer post 75 is connected to the corner post 74 through the interior skin 72 of the first panel 70. A second panel 80 comprises an exterior skin 81, an interior skin 82 and an insulating core 83. The exterior skin 81 overlaps the core 83 as shown in FIG. 5 and is of sufficient width to also cover the corner nailer post 75, the thickness of the interior skin 72, the corner post 74 and the thickness of the exterior skin 71, all associated with the panel 70. The interior skin 82 of the second panel 80 overlaps the core 83 a distance approximately equal to the thickness of the corner nailer post 75. When the corner is formed, one of the panels such as the first panel 70 is erected and secured. Thereafter, the panel 80 is disposed over a lower mounting plate 23 and is then moved in a direction of arrow C (FIG. 5) into adjoining relationship with the panel 70 as shown in FIG. 6. Thus, the panel 80 is appropriately located with respect to the panel 70 via the lower mounting plate 23, and more particularly via the interconnection of the various components of the panels 70 and 80. As will be appreciated, the corner construction as shown in FIG. 6 provides a corner which is substantially free of infiltration of the atmosphere or the elements from the outside of the corner to the inside of the corner, a very tortuous path being provided between the two panels when they are connected as described. Each of FIGS. 5 and 6 show for illustrative purposes appropriate nails (unnumbered) for connecting the elements together.

Figure 7:
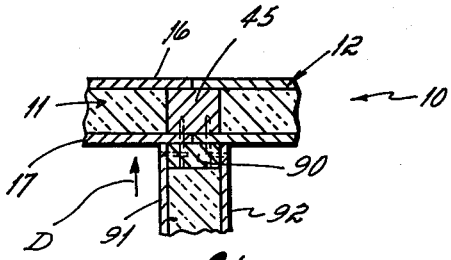
FIG. 7 is a top view illustrating the connection of an interior partition to a wall section.

It will also be appreciated that it may be necessary to connect an interior partition or panel in abutting relation with a wall section as has been described. Such a connection is shown in FIG. 7, wherein a nailer post 90 is nailed through interior skins 17 of abutting panels to a wall bearing post 45. Thereafter, an interior panel, including skins 91 and 92, is moved in the direction of arrow D and the skins are nailed directly into the sides of the nailer post 90. If the interior panel or partition includes a core, the skins 91 and 92 overlap the core a distance approximately equal to the thickness of the nailer post 90. In an alternate construction of interior partition connection to a wall section 10, the nailer post 90 may be secured to a wall panel (FIG. 4) via nailer strips 18 at a point spaced from the bearing post 45.

For the purpose of illustration only, the components of a wall section 10 may include an exterior skin of exterior grade plywood, an interior skin of drywall, a core of polymeric foam material, 2×4 foot plates, 4×4 wall bearing and wall splice bearing posts, and 2×6 header beams. Other size plates, posts and beams are used as required for particular structures.

In use, then, various wall sections 10, 60 and others are constructed at a manufacturing site and are thereafter transported to a construction site. The panels are lifted into place by crane, for example, with the exterior skins forming stops against the appropriately located mounting plates 23. When the wall sections are brought into final position against the mounting plates 23, they are secured in place and their accurate placement can be checked by virtue of the fact that the interior skins do not overlap the mounting plates 23. After the wall sections have been secured in place, a filler 95 (FIG. 2) of plywood or other material can be secured to the mounting plate 23 in order to cover the interior thickness of the mounting plate.

The ability to move a wall section 10 laterally into appropriate alignment with respect to the mounting plate 23 without having to manipulate the wall section in any other fashion (such as by lifting the section and dropping it precisely onto mounting elements), substantially increases the speed and efficiency by which the wall section can be erected to an appropriate deck and mounting plate, foundation, or like base. Moreover, the end structure of the various wall sections permits ready splicing between the wall sections at the construction site. While the header members of a wall section generally terminate over a wall section splice bearing post, the header members are otherwise cantilevered over the wall section bearing posts, with the splices being staggered, in order to provide substantial support for the completed building structure throughout each wall section.

Also, it will be appreciated that the usual brick, paint or siding can be applied to a wall section after erection. If desired, of course, siding or paint can be applied to the wall section at the factory site, prior to transportation of the section to the construction site.

Accordingly, the factory-manufactured panel and wall section offers distinct advantages over conventional construction methods for both the builder and the home-owner. The elimination of such on-site construction operations as insulating the wall and applying of interior wall material dramatically cuts building time and labor costs. The foamed core, as is well known, provides significant insulating qualities and thereby reduces heating and cooling costs as compared with conventional fiberglass bat insulation of equal thickness. Moreover, the interior and exterior wall material can be custom specified to provide complete design flexibility, and the post and header beam construction, together with the panel, offers superior structural advantages in shear strength and in lateral load capability. Also, where the foamed core is selected from a self-extinguishing material, as is well known, the panel offers significant fire resistance. Since the panels and the wall sections are accurately manufactured at a factory manufacturing site, construction labor costs, as stated, are significantly reduced, thus, in many instances providing a building of overall less cost.

Since the panels can be custom constructed as to width, length and other accommodating features, a wide variety of designs may be utilized without departing from the scope of the invention. For example, special window and door panels may be provided with appropriate headers and other features to provide for windows, doors and other custom features within any particular wall section.

All of these and other advantages will become readily apparent to one of ordinary skill in the art without departing from the scope of this invention and the applicant intends to be bound only by the claims appended hereto.

I claim:

1. A plurality of wall sections joined together on a deck means provided with a mounting plate, each of said wall sections comprising a plurality of insulated panels, each of which comprise an interior insulating core, an exterior skin and an interior skin, both of which have edge portions extending beyond said core, a header bearing post disposed between each panel, the interior and exterior skins of each panel respectively overlapping approximately one-half of said bearing post and being attached thereto, header means extending across the tops of said bearing posts, foot plate means extending beneath the bottoms of said bearing posts and edge portions of said interior and exterior skins covering said header means and said foot plate means, and further including means joining one wall section to another wherein each section includes at least one end panel, said joining means including a section splice bearing post disposed between said end panels, the skins of said end panels overlapping said section splice bearing post, header means bearing members connected to the sides of upper portions of said section splice bearing post, and a relieved portion in the insulating core of each end panel for receiving one of said header means bearing members.

2. Apparatus as in claim 1 wherein said header means comprises inner and outer header beams having edges disposed on said header bearing posts, the thickness of said edges being less than the width of said header beams, and said inner and outer header beams being parallel and spaced apart from each other.

3. Apparatus as in claim 2 wherein at least one of said inner and outer header beams comprises two selected header beams having ends disposed intermediate two header bearing posts and adjacent each other at a splice area, further including a splice plate between inner and outer parallel header beams at said splice area, each of said two selected header beams connected to said splice plate proximate said adjacent ends.

4. Apparatus as in claim 3 wherein selected wall sections at the ends of a plurality of joined together wall sections have an insulated outer end panel on the outer ends thereof, each insulated outer end panel having an outer portion defining an end of said plurality of joined wall sections, and wherein said header beams associated with said end panels terminate at a position disposed over a respective header bearing post associated with said outer portion of each respective insulated outer end panel.

5. Apparatus as in claim 1 wherein header means associated with each end panel terminate over said section splice bearing post in abutting relationship and including means connecting said abutting header means.

6. Apparatus as in claim 1 wherein said interior skin of each panel covers said foot plate and terminates proximate an edge of said foot plate and wherein said exterior skin of each panel covers said foot plate and extends beyond said foot plate to provide a locating surface for cooperating with a mounting plate.

7. Apparatus as in claim 6 wherein said exterior skins extends beyond the core of said panels at a bottom edge thereof a distance equal to the thickness of said foot plate and said mounting plate.

8. Apparatus as in claim 7 wherein said foot plate engages said mounting plate when said wall sections are erected on a deck means.

* * * * *